US006468134B1

(12) United States Patent
Gotkis

(10) Patent No.: US 6,468,134 B1
(45) Date of Patent: Oct. 22, 2002

(54) METHOD AND APPARATUS FOR SLURRY DISTRIBUTION

(75) Inventor: Yehiel Gotkis, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 68 days.

(21) Appl. No.: 09/608,508

(22) Filed: Jun. 30, 2000

(51) Int. Cl.[7] ..... B24B 1/00

(52) U.S. Cl. ..... 451/36; 451/41; 451/56; 451/60; 451/72; 451/306; 451/446

(58) Field of Search ..... 451/5, 36, 41, 451/56, 60, 72, 306, 446

(56) References Cited

U.S. PATENT DOCUMENTS 5,775,983 A * 7/1998 Shendon et al. ..... 451/285
5,779,526 A * 7/1998 Gill ..... 451/242
6,086,460 A * 7/2000 Labunsky et al. ..... 451/443
6,139,404 A * 10/2000 Yau ..... 451/56
6,220,936 B1 * 4/2001 Quek ..... 451/285
6,343,977 B1 * 2/2002 Peng et al. ..... 451/242

* cited by examiner

*Primary Examiner*—Timothy V. Eley
(74) *Attorney, Agent, or Firm*—Martine & Penilla, LLP

(57) ABSTRACT

A method and apparatus for slurry distribution is provided. The apparatus for the distribution of slurry over a polishing pad surface used in chemical mechanical polishing includes a roller positioned over a polishing pad surface. The roller is connected with a gimbaling attachment to a positioning arm and is configured to apply a force against the polishing pad surface while maintaining a surface of the roller substantially parallel to the polishing pad surface. The gimbaled roller drives the slurry into and over the porous texture of the polishing pad surface and ensures a substantially even distribution of slurry. In another example, a double roller apparatus is also provided and is configured to combine slurry distribution and pad conditioning.

17 Claims, 9 Drawing Sheets

METHOD AND APPARATUS FOR SLURRY DISTRIBUTION

BACKGROUND OF THE INVENTION

1. Field of the Invention

The present invention relates generally to chemical mechanical polishing (CMP) systems and techniques for improving the performance and effectiveness of CMP operations. Specifically, the present invention relates to the distribution of micro-abrasive suspension, or slurry, underneath the wafer in CMP operations.

2. Description of the Related Art

In the fabrication of semiconductor devices, there is a need to perform CMP operations, including polishing, buffing and wafer cleaning. Typically, integrated circuit devices are in the form of multi-level structures. At the substrate level, transistor devices are formed. In subsequent levels, interconnect metallization lines are patterned and electrically connected to the transistor devices to define the desired functional device. As is well known, patterned conductive layers are insulated from each other by dielectric materials, such as silicon dioxide, for example. As more metallization levels and associated dielectric layers are formed, the need to planarize the dielectric material increases. Without planarization, fabrication of additional metallization layers becomes substantially more difficult due to the higher variations in the surface topography. In other applications, metal line patterns are formed in the dielectric material, and then metal CMP operations are performed to remove excess metallization, e.g., such as copper.

In the prior art, CMP systems typically implement belt, orbital, or brush stations in which belts, pads, or brushes are used to scrub, buff, and polish a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1A illustrates an exemplary prior art CMP system 100. The CMP system 100 in FIG. 1A is a belt-type system, so designated because the preparation surface is an endless belt 108 mounted on two drums 114 which drive the belt 108 in a rotational motion as indicated by belt rotation directional arrows 116. As used herein, the belt 108 should be understood to include a polishing pad or other preparation surface material in addition to any supporting material, such as aluminum, stainless steel or any suitable supporting structural material for holding the pad or other preparation surface. A wafer 102 is mounted on a carrier 104. The carrier 104 is rotated in direction 106. The rotating wafer 102 is then applied against the rotating belt 108 with a force F to accomplish a CMP process. Some CMP processes require significant force F to be applied. A platen 112 is provided to stabilize the belt 108 and to provide a solid surface onto which to apply the wafer 102.

Slurry 118 is introduced upstream of the wafer 102. In a belt-type CMP system 100, slurry 118 is commonly introduced in a region that is upstream and off-center from the wafer 102 as illustrated in FIG. 1A. The movement of the belt 108 carries the slurry 118 to the wafer 102 which is mounted on the carrier 104 and being applied against the belt 108 with a force F as it is being rotated 106. The rotation 106 of the wafer 102 and the friction of the wafer 102 against the belt 108 further distributes the slurry 118 across and into the polishing pad or other preparation surface of the belt 108 and over the surface of the wafer 102. In FIG. 1C, the effect of the moving belt 108 and the rotating wafer 102 is illustrated. As the slurry 118 approaches the wafer 102 from upstream and off-center, it is distributed across the belt 108, facilitating the CMP operation and moving beyond the wafer 102 having been distributed across a larger region of the belt 108. Slurry 118*a* is shown after passing the wafer 102 and having been distributed across the belt 108 during the CMP operation on wafer 102.

Slurry 118, as is known, is a water-based suspension consisting of dispersed micro-abrasives, dissolved chemicals and in some cases, lubricants. The fluid properties of the suspension allow for the even distribution of the abrasive material across a surface and enhance the effectiveness of the CMP operation. Both solid abrasives and fluid chemicals, including water, modify the surface properties of interacting objects, thus promoting smooth removal. A section of a typical CMP belt 108 and the porous texture of the polishing pad or other preparation surface is illustrated in FIG. 1B. As stated above, the belt provides the supporting structure for the polishing pad or other preparation surface. In FIG. 1B, the polishing pad surface of the belt 108 is shown as uneven or rough and contributing an abrasiveness. Slurry 118 is distributed over the pad surface 108, but due to the fluid properties, the micro-abrasives, surface tension, capillary openings in the belt 108 surface blocked by air, and other such factors, the slurry does not penetrate into the surface cavities through the usual distribution method described above. FIG. 1B shows capillary openings blocked by air pockets 119 that form in the surface cavities and result in uneven and unstable slurry distribution. Non-uniform slurry distribution can result in less efficient and non-uniform planarization of wafers being processed. Further, if slurry 118 loses the fluid properties due to build-up and drying, then the micro-abrasives collect and "cake" forming chunks of abrasive debris. This abrasive debris, in the extreme, can damage the quality of the semiconductor wafer being processed in a CMP operation. Typically, such debris contributes to non-uniform planarization and wafer defects. In addition to the air pockets 119 shown in FIG. 1B, the polishing pad surface 108 can accumulate build-up of dried slurry 118. As the slurry build-up dries, chunks of abrasive debris form.

One method of removing and preventing build-up on the pad surface 108 is illustrated in FIG. 1A. A belt conditioner assembly 110 is mounted down-stream from the wafer 102. The belt conditioner assembly 110 consists of an abrasive head that is applied against the polishing pad surface 108 to dislodge any abrasive debris that may be on the polishing pad 108. Further, the belt conditioner assembly 110 renews the surface cavities in the polishing pad 108 to ensure the pad 108 retains its abrasive properties, and the ability to hold and transport slurry into the CMP operation. As the belt continues to rotate, the conditioner assembly 110 provides constant conditioning of the pad 108 during CMP operations. Or, the conditioning assembly 110 can be programmed to condition the pad 108 at intervals according to operator requirements.

The increased complexity of multi-layered semiconductor chips requires more precise and more uniform planarization techniques. CMP is and will remain an integral part of the semiconductor wafer manufacturing process, but must be made more effective and more controllable to meet the increasing demands for more complex fabrication. In view of the foregoing, there is a need for slurry distribution methods and apparatus in CMP operations that are more controllable, that more evenly and uniformly distribute slurry across a preparation surface, and that minimize the risks of damage due to dried slurry and abrasive debris.

SUMMARY OF THE INVENTION

Broadly speaking, the present invention fills these needs by providing systems and methods for the uniform and even distribution of slurry in a CMP system. The gimbaled roller system and method provide a controllable distribution of slurry to create a more efficient and effective CMP operation with fewer substrate defects. It should be appreciated that the present invention can be implemented in numerous ways, including as a process, an apparatus, a system, a device or a method. Several inventive embodiments of the present invention are described below.

In one embodiment, an apparatus for even slurry distribution in CMP operations is disclosed. The apparatus is a gimbaled roller consisting of a roller, a gimbaling roller attachment attached to the roller, and a positioning arm attached to the gimbaling roller attachment to position the roller for the even distribution of slurry.

In another embodiment, an apparatus for distributing slurry over a polishing pad surface used in chemical mechanical polishing of a substrate is disclosed. The apparatus includes a belt assembly having the polishing pad surface that rotates in a loop. A roller is positioned over the polishing pad surface and has a gimbaling attachment configured to ensure that a surface of the roller is maintained substantially parallel to the polishing pad surface.

In still a further embodiment, a method for distributing slurry in a chemical mechanical polishing system is disclosed. The method includes introducing slurry onto a chemical mechanical polishing surface and moving the chemical mechanical polishing surface. The method further provides applying a roller against the chemical mechanical polishing surface as the slurry is moved on the moving chemical mechanical polishing surface toward the roller, and distributing the slurry as an even film over the chemical mechanical polishing surface.

In yet another embodiment, an apparatus for combined pad conditioning and slurry distribution is disclosed. The apparatus includes a polishing pad with a polishing pad surface, and a first and a second roller positioned before a wafer polishing application location. The first roller has an abrasive surface that is applied to the polishing pad surface, and the second roller is defined below the polishing pad surface to support the polishing pad at a location where the first roller is applied. Thus configured, the first roller conditions the polishing pad surface and distributes slurry over the polishing pad surface.

The advantages of the present invention include the providing of more control over the chemical mechanical polishing operation. The present invention allows for the setting and maintaining of a designated thickness of slurry on a polishing pad or other preparation surface. By applying pressure with a gimbaled roller of the invention, air pockets are displaced in the porous surface of the polishing pad, and slurry is distributed in an even and uniform thickness across the pad. The slurry is also distributed across the width of the polishing pad surface of the belt resulting in a uniform and controllable amount of slurry at the substrate for CMP processing. More control over the slurry in CMP operations yields more precise processing with fewer defects.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION OF THE PREFERRED EMBODIMENTS

An invention for CMP wafer operations, namely, a gimbaling roller (e.g., made of elastomeric material), for the distribution of slurry on a CMP pad, belt, or other preparation surface is disclosed. In preferred embodiments, methods for the even distribution of slurry in a CMP system include using a gimbaled roller to ensure even distribution across the preparation surface as well as constant and even pressure to infuse slurry into the porous texture of a polishing pad or other preparation surface as appropriate. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 2A:
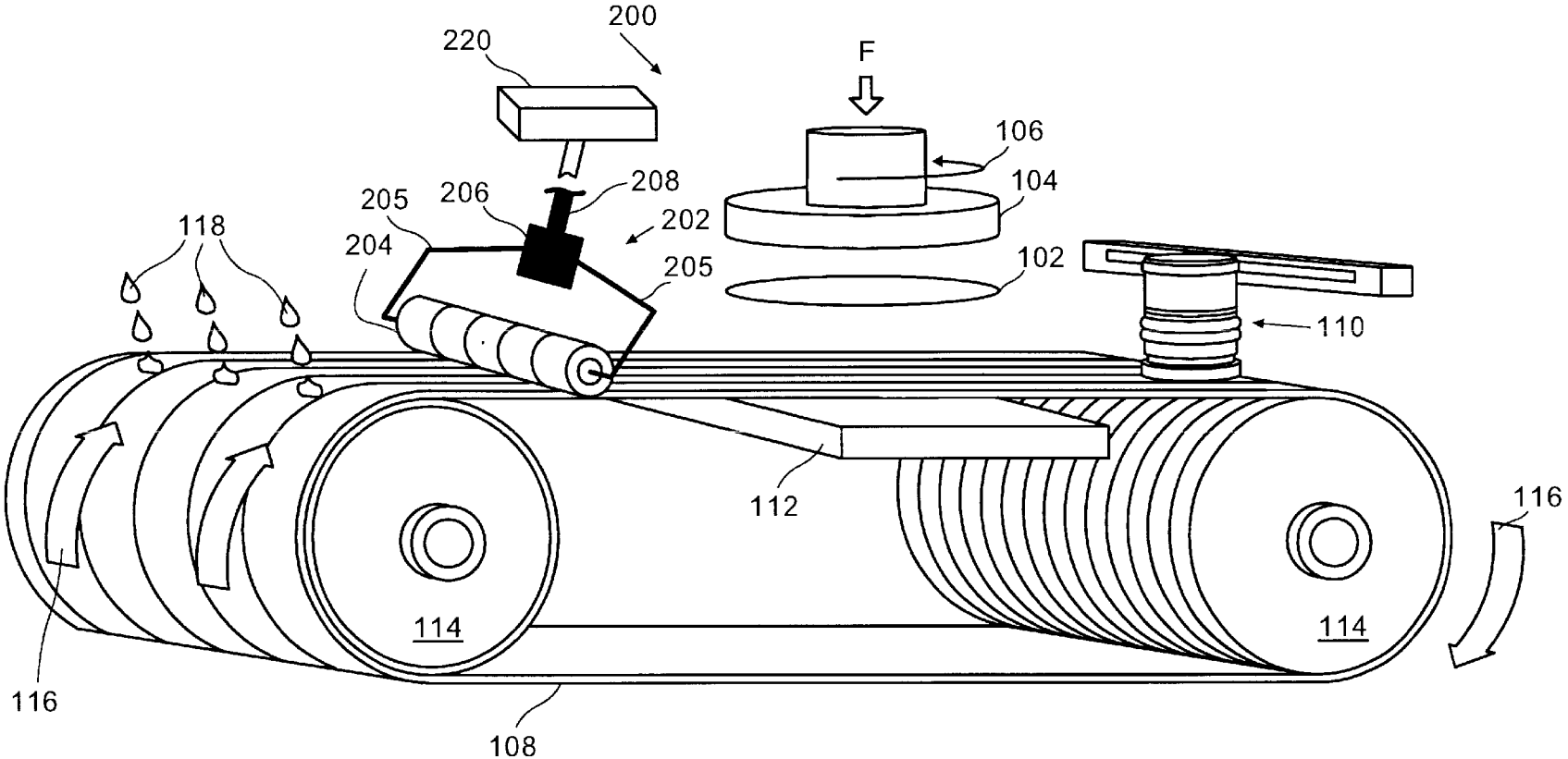
FIG. 2A is a three dimensional view of a CMP system in accordance with one embodiment of the present invention.

FIG. 2A is a three dimensional view of a CMP system 200, in accordance with one embodiment of the present invention. The CMP system 200 shown is an exemplary belt-type system including a belt 108 preparation surface mounted around two drums 114. The drums 114 rotate and impart the rotation on the belt in the direction as shown by arrows 116. A wafer 102 is mounted on a carrier 104 which has a rotation 106. The rotating carrier 104 and wafer 102 are applied against the belt 108 as it rotates 116 with a force F. A platen 112 is located under the belt 108 and provides a stable and secure support for CMP operations.

Slurry 118 is introduced onto the pad surface 108 upstream of the wafer 102. In one embodiment, slurry is dispensed through a manifold (see FIG. 2D) that is configured to span the width of the belt 108. In a slurry distribution manifold embodiment, slurry 118 is not deposited in a single region that is off-center from the wafer 102, but rather is dispensed across the entire pad surface 108. Since the belt 108 rotates 116, the slurry 118 is transported to the wafer 102 by the movement of the belt 108.

Before reaching the wafer 102, the slurry 118 travels under a gimbaled roller apparatus 202 in accordance with one embodiment of the present invention. A roller 204 is attached by a roller arm 205 to a gimbaling roller attachment 206. As described in greater detail below, the gimbaling roller attachment 206 ensures the roller 204 is maintained at a constant, even force against the surface of the moving belt 108. In one embodiment, the roller 204 is made of an elastomeric material, like polyurethene to provide better conformity with the polishing pad surface. The gimbaled roller apparatus 202 is positioned over the belt 108 by a control arm 208 which is controlled by a position controller 220.

Figure 1A:
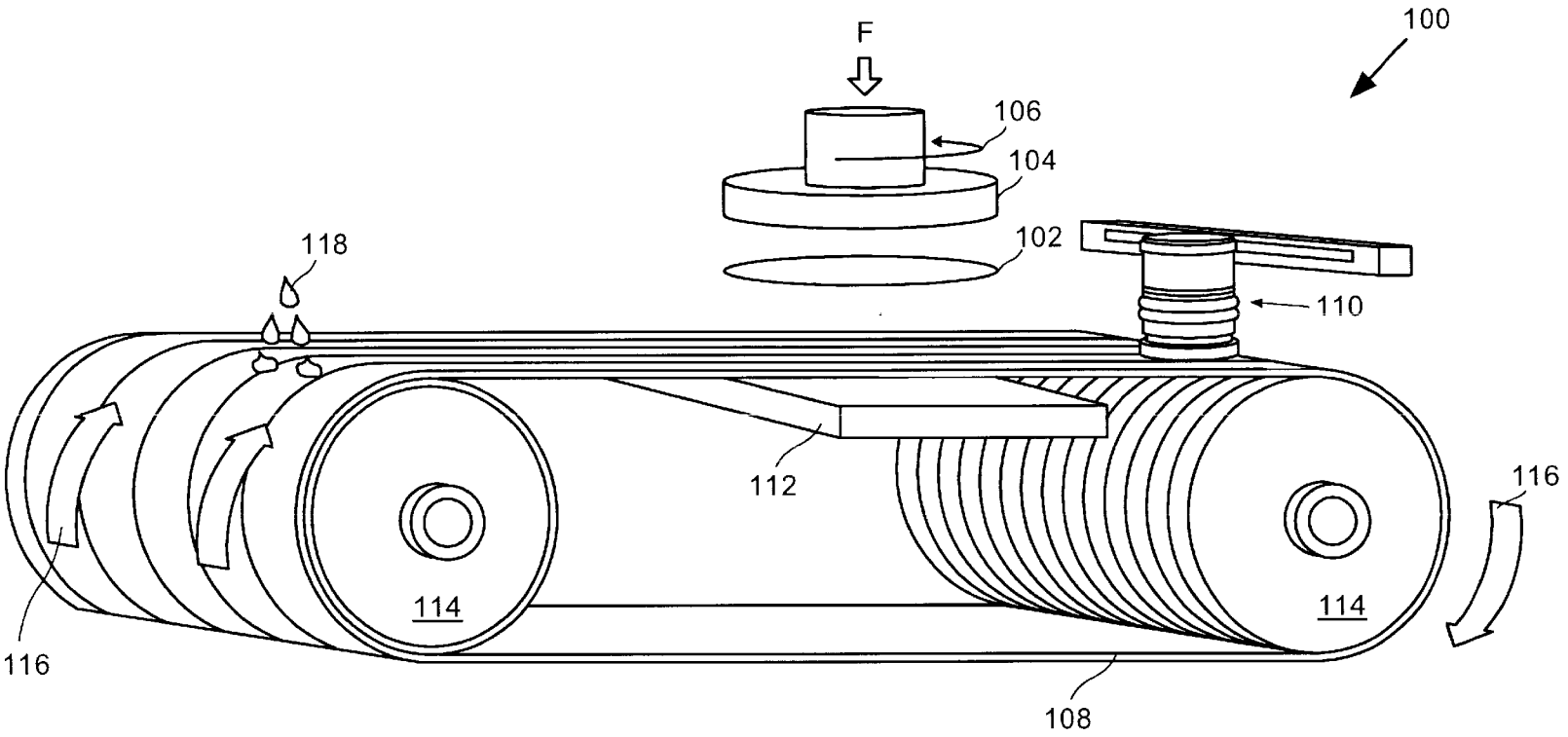
FIG. 1A (prior art)
FIG. 1A illustrates an exemplary prior art CMP system.
Figure 1B:
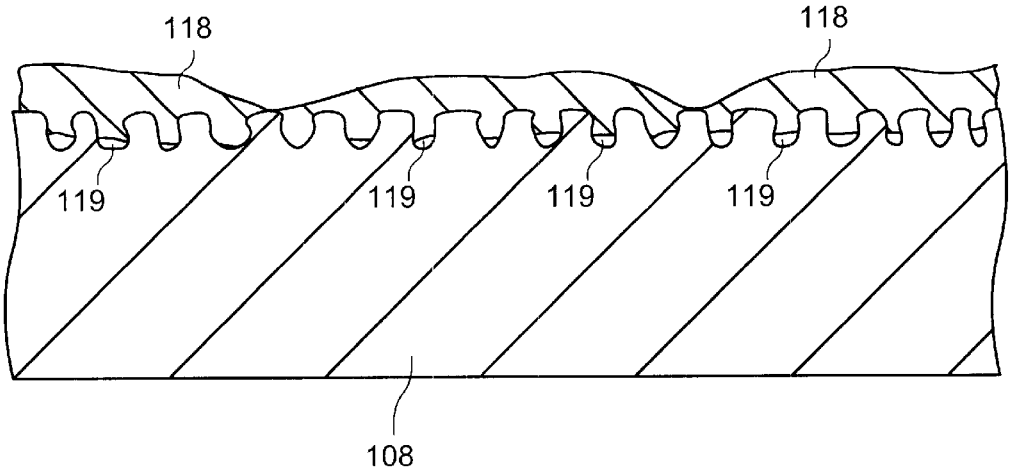
FIG. 1B (prior art)
FIG. 1B illustrates section of a typical CMP belt and the porous texture of the polishing pad or other preparation surface.
Figure 1C:
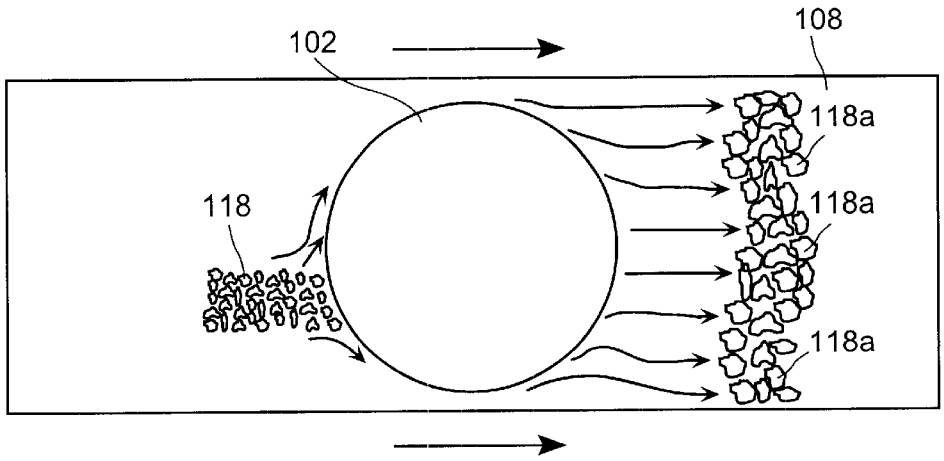
FIG. 1C (prior art)
FIG. 1C shows the effect of the moving belt and the rotating wafer on slurry distribution.

A pad conditioning assembly 110 is configured downstream from the wafer 102. It could be also installed upstream from the wafer. As described above, the pad conditioning assembly 110 provides an abrasive head for the conditioning and maintenance of the polishing pad or other preparation surface of the belt 108. As can be seen in FIG. 1B, one embodiment of the polishing pad or other preparation surface 108 is porous and includes multiple surface cavities. Process by-products can collect in these cavities as build-up, or slurry 118 can dry out and be trapped in the cavities, blocking them. Acting as a key feature providing slurry transport underneath the wafer, the pores and the surface of the polishing pad or other preparation surface 108 need to be kept free of build-up and other debris. It is the function of the pad conditioning assembly 110 to clean, condition, and maintain the polishing pad or other preparation surface 108 for optimum CMP operations.

In one embodiment, the belt conditioner assembly 10 includes an abrasive head with a narrower surface area than the width of the belt 108. In this embodiment, the belt conditioner assembly 110 is configured to sweep across the belt 108 while being applied against the belt 108 with a down force. Due to the sweeping action across the rotating belt 108, the entire polishing pad or other preparation surface 108 is conditioned during sustained CMP operations.

In another embodiment, the belt conditioner assembly includes an abrasive head spanning the width of the belt 108. In this embodiment, the belt conditioner assembly 110 is configured to be applied against the moving belt 108 across the entire width of the belt 108. In one embodiment, the conditioning is a constant process of the CMP operation. In another embodiment, the conditioning is programmed to occur intermittently in accordance with the needs of the specific operation.

Figure 2B:
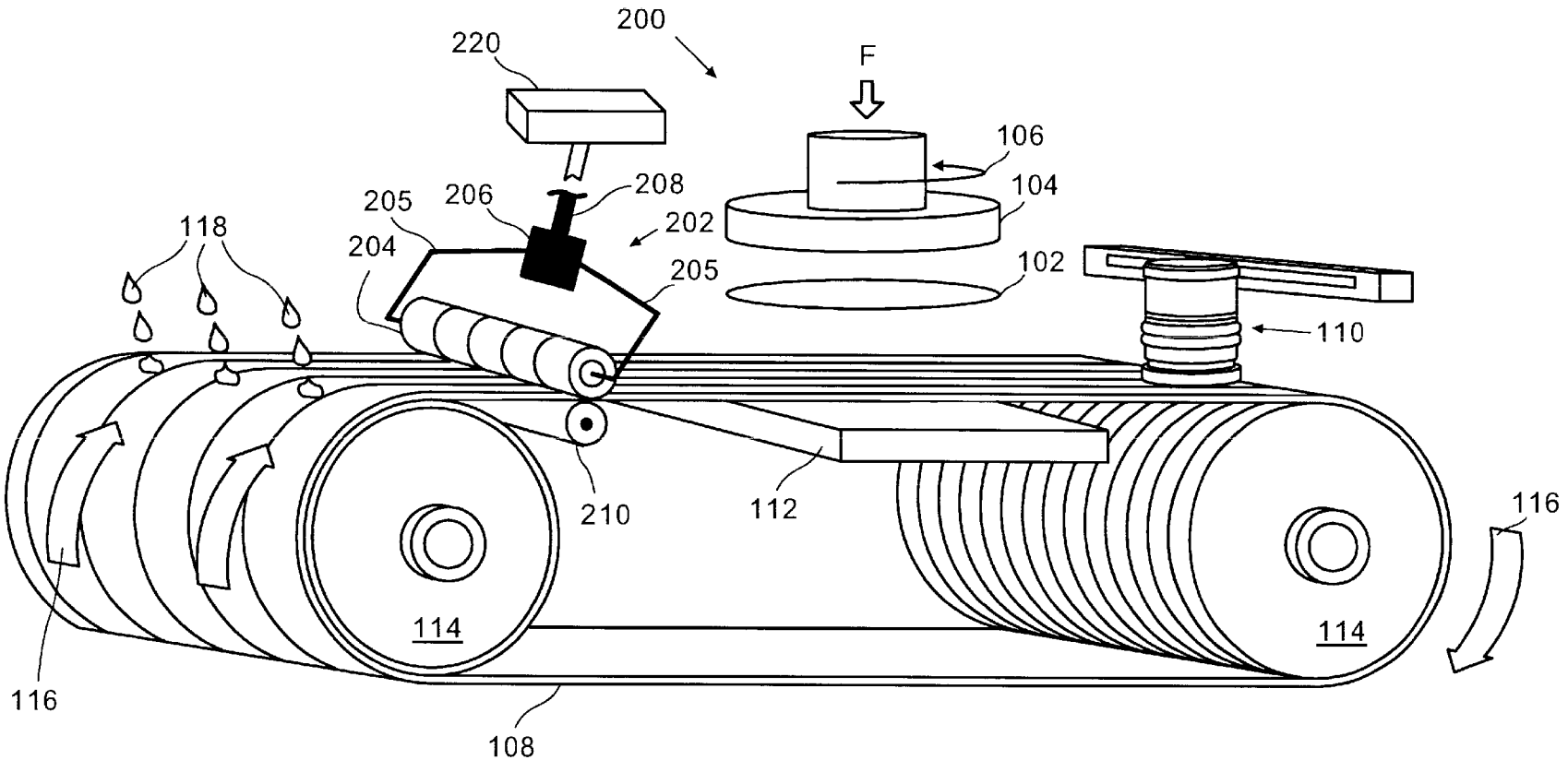
FIG. 2B is a three dimensional view of a CMP system in accordance with another embodiment of the present invention.

FIG. 2B is a three dimensional view of a CMP system 200, in accordance with another embodiment of the present invention. FIG. 2B depicts the same CMP system 200 as described in FIG. 2A, but the CMP system 200 in FIG. 2B incorporates a support roller 210. The support roller 210 functions in a similar manner as the platen 112. Just as the platen 112 provides support and a stable surface for the rotating carrier 104 to be applied against the belt 108 with force F, the support roller 210 provides an opposing roller to the gimbaled roller apparatus 202. The support roller 210 is designed as a roller to minimize generated friction between the moving belt 108, the roller 204 and the support roller 210 while providing support for the roller 204 to be applied against the belt 108 with force. In another embodiment, the support roller 210 is designed with a platen-like structure. Because the gimbaled roller apparatus 202 is a gimbaled structure, the support roller 210 need not be gimbaled, and is configured to provide a support surface with a minimum of generated friction.

In another embodiment, a double roller device (e.g., a first top roller and a second bottom roller) can be used to provide a combined conditioning plus slurry distribution action. In this case the upper roller 204 is made of a rigid material, covered with a diamond grid to provide an abrasive action. The lower roller 210 is made of elastic material like polyurethene to provide system compliance.

Figure 2C:
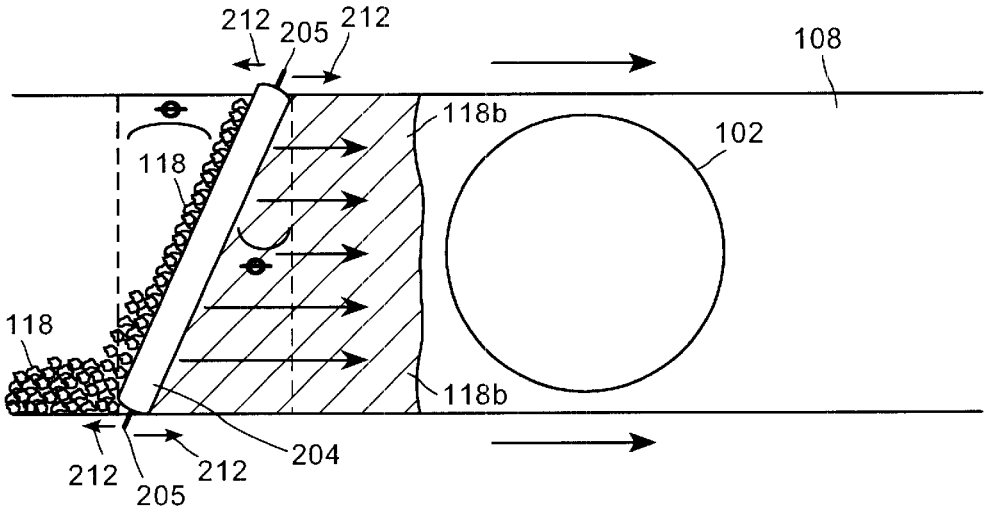
FIG. 2C shows the distribution of slurry on a polishing pad or other preparation surface by the roller in accordance with one embodiment of the invention.

FIG. 2C shows the distribution of slurry 118*b* on a polishing pad or other preparation surface 108 by the roller 204 in accordance with one embodiment of the invention. The roller 204, attached to the roller arm 205 is positioned at an angle θ across the belt 108. The position controller 220 (see FIG. 2A) moves the control arm 208 (see FIG. 2A) to position the roller 204 at an optimum position across the belt 104 according to the configuration of a particular system. The control arm 205 moves in movement direction 212 to achieve the desired position of the roller 204 across the belt 108. In FIG. 2C, slurry 118 is introduced at a point upstream and off-center from the wafer 102. The roller 204 is positioned at angle θ across the belt 104 to provide maximum distribution of slurry 118 across the belt 108.

The slurry 118 travels along the length of the roller 204. As is described in greater detail below, the gimbaling feature of the roller 204 provides a constant, flat point of contact between the roller 204 and the polishing pad or other preparation surface 108 (or the slurry that is on the polishing pad or other preparation surface 108). As the slurry 118 travels under the roller 204, it is pressed into the porous surface of the polishing pad 108 and is evenly and uniformly distributed across the polishing pad surface of the belt 108. The slurry 118*b* then travels with the belt 108 to the wafer 102 where the CMP process is accomplished with more precision and control.

Figure 2D:
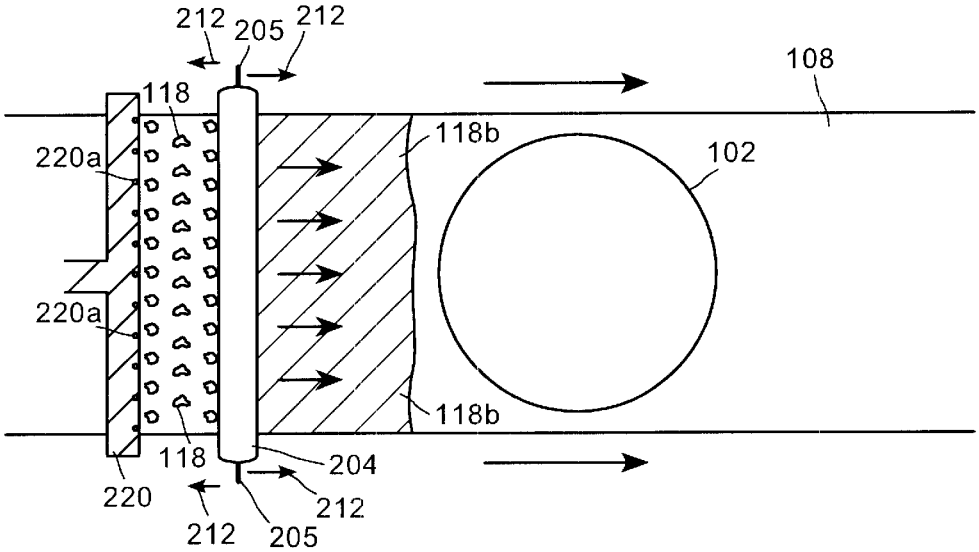
FIG. 2D shows the distribution of slurry on a polishing pad or other preparation surface by the roller in accordance with another embodiment of the invention.

FIG. 2D shows the distribution of slurry 118*b* on a polishing pad or other preparation surface 108 by the roller 204 in accordance with another embodiment of the invention. As described in reference to FIG. 2C, the control arm 205 moves in movement direction 212 to achieve the desired position of the roller 204 across the belt 108. In FIG. 2D, the optimum position is with the roller 204 perpendicular to the belt 108. A slurry distribution manifold 220 is shown positioned over and across the belt 108. Slurry 118 is dispensed by the slurry distribution manifold 220 through slurry distribution ports 220*a*. Slurry 118 is dispensed across the width of the belt 108. As the slurry 118 travels under the roller 204, it is pressed into the porous texture of the polishing pad surface 108 and distributed evenly and uniformly across the polishing pad surface 108. The slurry 118*b* then travels to the wafer 102 for more precise and controllable CMP processing.

Figure 3A:
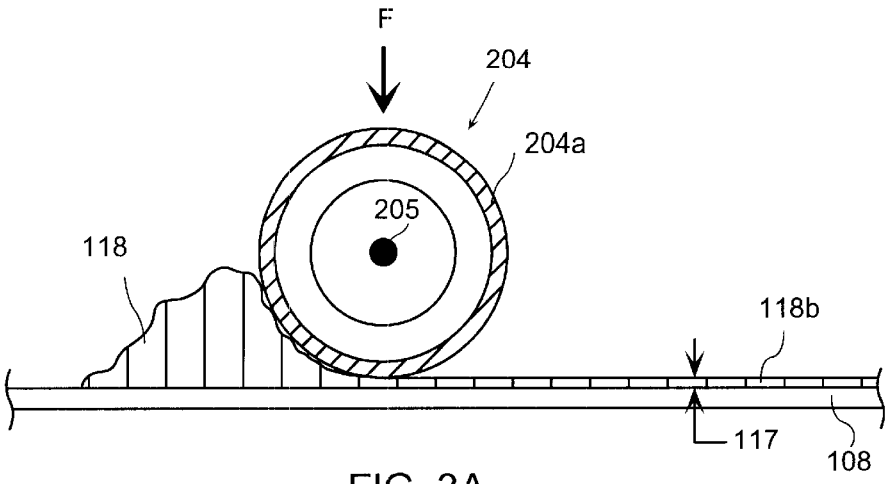
FIG. 3A shows the action of the roller on the slurry in accordance with one embodiment of the invention.

FIG. 3A shows the action of the roller 204 on the slurry 118 in accordance with one embodiment of the invention. Slurry 118, as is known, consists of micro-abrasives and dissolved chemicals in suspension. Typically, slurry 118 is introduced into the CMP operation in droplets from a slurry dispensing system. One example of a slurry dispensing system is the slurry distribution manifold 220 as described in reference to FIG. 2D. In FIG. 3A, a droplet of slurry 118 reaches the roller 204. The roller 204 has a roller surface 204*a* designed to distribute the slurry 118 across the surface of the belt 108 and into the porous texture of the polishing pad surface 108. The roller 204 is attached to a roller arm 205 that positions the roller 204 across the polishing pad surface 108 as described above in reference to FIG. 2C. The roller arm 205 also positions the roller 204 at a determined distance from or with a determined pressure against the belt 108. Applying the roller 204 against the belt 108 with force F presses the slurry 118 into the porous polishing pad surface 108 for more even, uniform, and controllable distribution. The roller 204 is configured to distribute the slurry 118 in a uniform thickness 117 across the belt 108 to deliver a uniform distribution of a controlled amount of slurry 118*b* to the wafer 102 (not shown) as required for specific CMP operations. A polishing pad surface 108 that is constantly conditioned as described above will deliver a constant and controllable amount of slurry 118*b* at a desired thickness 117 for specific CMP operations.

Figure 3B:
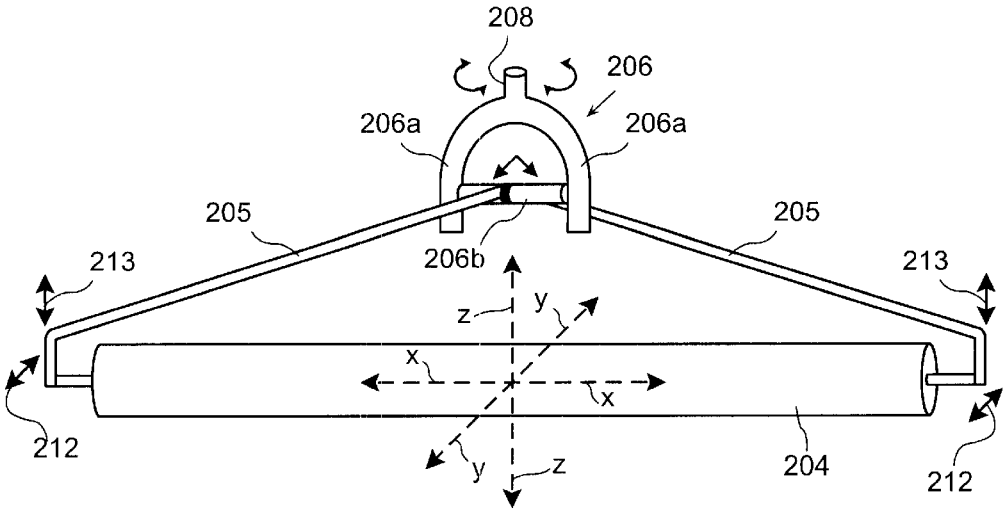
FIG. 3B shows a detail view of the gimbaling roller attachment in accordance with one embodiment of the invention.

FIG. 3B shows a detail view of the gimbaling roller attachment 206 in accordance with one embodiment of the invention. The gimbaling roller attachment 206 is attached to a position controller 220 (see FIG. 2A) with a control arm 208. The control arm 208 rotates the gimbaling roller attachment 206 in the horizontal plane. This controls the positioning of the roller 204 across the belt 108 (not shown). Rotation of the control arm positions the roller 204 from exactly perpendicular to the direction of motion of the belt 108, through any angle θ as described above in reference to FIG. 2C. Movement of the roller in the horizontal plane is represented by directional arrows 212. Further, the position controller 220 (not shown) raises and lowers the control arm 208 to position the roller 204 in the vertical plane from a set distance above the belt 108 through a desired pressure against the belt 108. Movement of the roller 204 in the vertical plane is represented by directional arrows 213.

The roller 204 is attached to the gimbaling roller attachment 206 by the roller arm 205. The roller arm 205 connects to the gimbal connector 206*b* which is attached to the gimbal support 206*a*. The gimbal connector freely spins in its mounting in the gimbal support 206*a*, being mounted by known gimbaling techniques. Thus mounted, the gimbaling roller attachment 206 provides that contact between the roller 204 and the polishing pad or other preparation surface 108 (or layer of slurry on the polishing pad or other preparation surface 108) is constantly maintained. The gimbaling action controls movement of the roller in the vertical plane, but such movement is equal and opposite on opposite ends of the roller 204. If one end of the roller 204 is moved in an upward component of direction 213, then the opposite end of the roller 204 must move an equal distance in the downward component of direction 213. This provides both uniform distribution of slurry across the pad 108 as well as forcing the slurry into the surface cavities of the polishing pad or other preparation surface 108. Under a constant, even pressure, the air is forced out of the capillary openings in the porous pad surface 108 and displaced by slurry 118. This provides not only the uniform distribution of slurry 118 across the belt 108, but the ability to set and control a uniform thickness of slurry 118 on and into the polishing pad or other preparation surface 108.

Further still, the control arm 208, responding to directional signals from the position controller 220 (not shown) positions the gimbaling roller attachment 206 and roller 204 along the belt 108 at a desired distance from the carrier 104 (see FIG. 2A). In a preferred embodiment, the roller 204 is positioned as close to the carrier 104 (not shown) as possible. The control arm positions the roller along the belt 108 in accordance with the requirements of the specific CMP operation. The control arm 208 and gimbaling roller attachment 206 thus provide positioning and movement of the roller 204 through the various planes of movement in the "x," "y" and "z" axes.

Figure 4A:
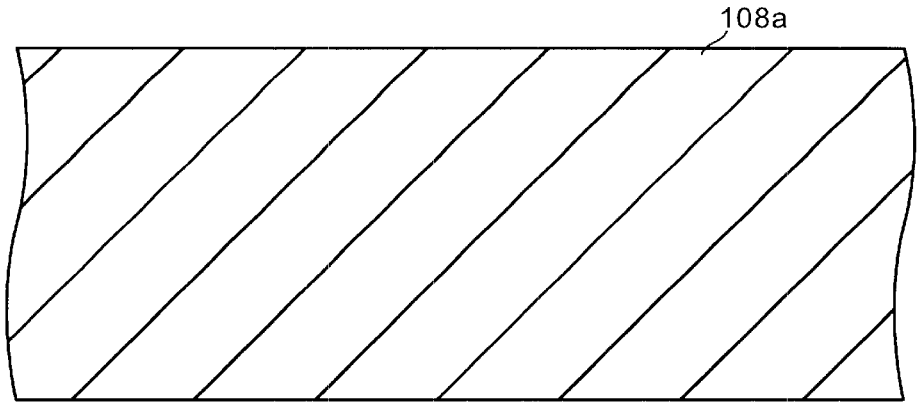
FIGS. 4A and 4B show two different embodiments of surface textures of a polishing pad or other preparation surface.
Figure 4B:
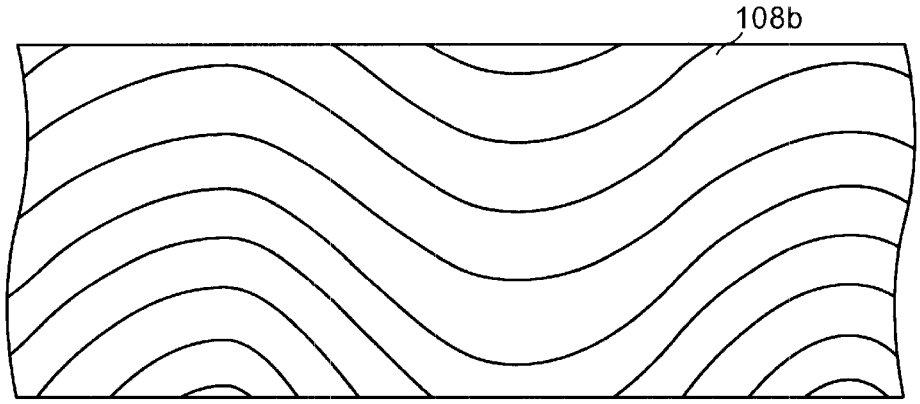

FIGS. 4A and 4B show two different embodiments of surface textures of a polishing pad or other preparation surface 108. As described in detail above, the gimbaled roller apparatus 202 (see FIG. 2A) distributes slurry 118 (not shown) across the belt 108, as well as into the porous surface of the pad 108. In one embodiment of the present invention, the uniform distribution of slurry across the polishing pad or other preparation surface 108 is enhanced by the surface texture of the pad 108. In FIG. 4A, the porous surface texture of the pad 108*a* contains diagonal ridges and/or troughs in order to facilitate the distribution of slurry across the surface of the pad 108*a*. In FIG. 4B, the ridges and or troughs are configured to provide a spiral or swirl surface texture to the pad 108*b*.

As described above in reference to FIG. 3A, roller 204 has a roller surface 204*a*. In one embodiment of the present invention, the exemplary polishing pad or other preparation surface textures 108*a*, 108*b* illustrated in FIGS. 4A and 4B are also the textures configured to roller surface 204*a*. In this manner, the distribution of slurry 118 is enhanced by both the roller 204 and the belt 108 for an effective uniform distribution of slurry 118 across the belt 108.

Figure 5A:
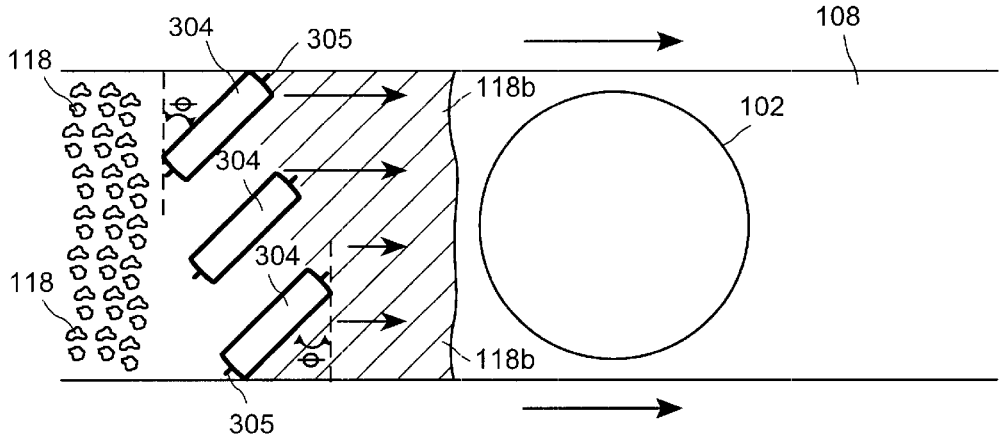
FIG. 5A shows three rollers connected to three roller arms positioned in parallel across a belt in accordance with one embodiment of the present invention.
Figure 5B:
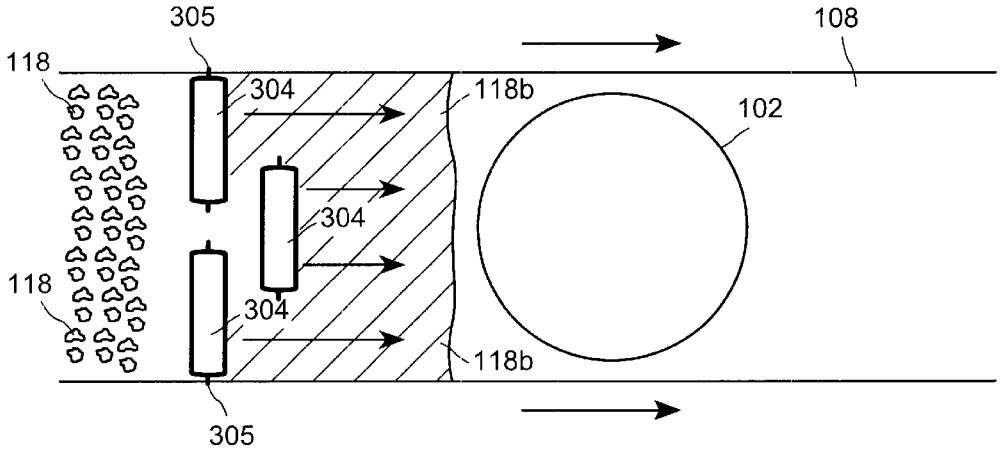
FIG. 5B shows multiple rollers positioned perpendicular to the direction of movement of belt in accordance with an embodiment of the invention.

FIGS. 5A and 5B illustrate multiple roller 304 configurations of a gimbaled roller apparatus in accordance with another embodiment of the present invention. In FIG. 5A, three rollers 304 connected to three roller arms 305 are positioned in parallel across belt 108. In this embodiment, the rollers 304 are positioned in parallel at an angle θ across belt 108 such that slurry 118 traveling along the belt 108 must come in contact with some surface of at least one of the three rollers 304 before reaching wafer 102. As described in detail above in reference to FIG. 2C, slurry 118 is distributed across and into the porous polishing pad or other preparation surface 108 to form a controllable and uniform slurry 118*b* at the wafer 102 for precise CMP processing.

FIG. 5B shows multiple rollers 304 positioned perpendicular to the direction of movement of belt 108 in accordance with an embodiment of the invention. In FIG. 5B, three rollers 304 are connected to three roller arms 305 and positioned across belt 108 and perpendicular to the movement of belt 104. Slurry 118 traveling on belt 108 must pass through some surface of at least one of the rollers 304. In this manner, slurry 118 is distributed along and into the porous polishing pad or other preparation surface 108 to form evenly distributed and controllable slurry at wafer 102 enhancing the precision of CMP operations.

Figure 6:
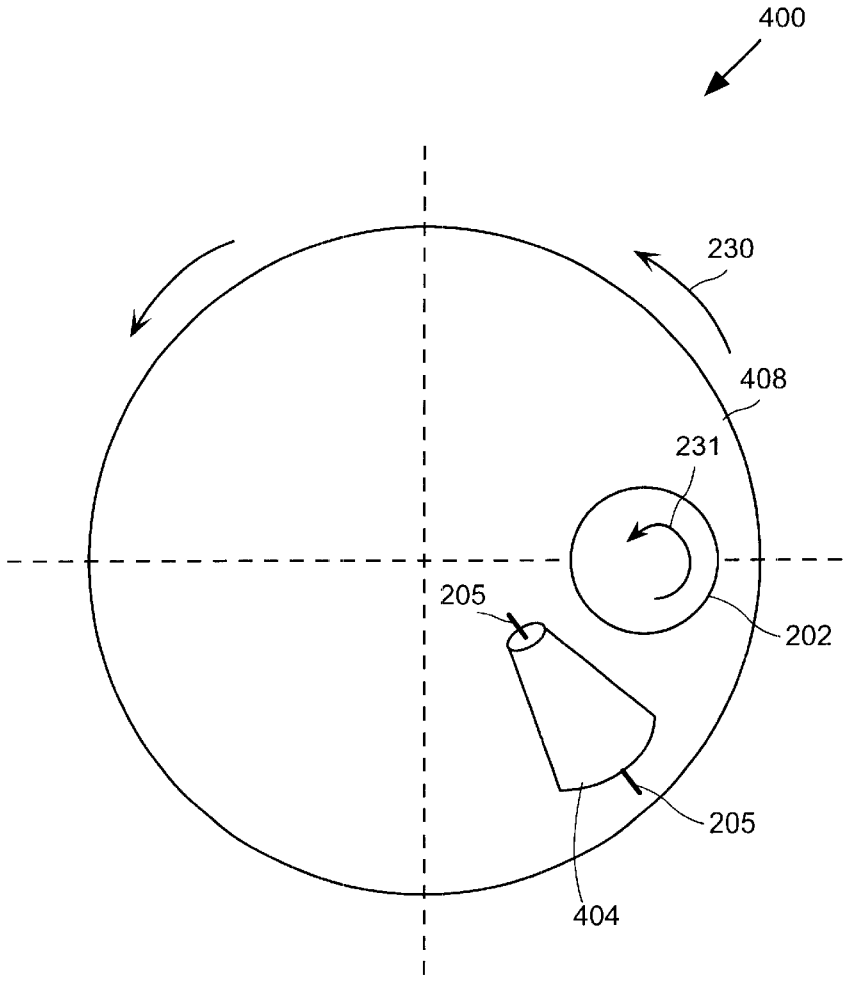
FIG. 6 shows the position of a gimbaled roller on a CMP system in accordance with yet another embodiment of the present invention.

FIG. 6 shows the position of a gimbaled roller 404 on a CMP system 400 in accordance with yet another embodiment of the present invention. The CMP system 400 represented in FIG. 6 is an orbital CMP system 400. A wafer 202 with rotation 231 is applied to pad 408 which has rotation 230. As described in detail above, in a preferred embodiment of the invention, the roller 404 is positioned as close to the wafer 202 as possible. In the embodiment shown in FIG. 6, the roller 404 is positioned in the quadrant of the pad 408 adjacent to the wafer 202. The roller 404 is attached to roller arm 205 for positioning and application of force as described above. The roller 404 in the embodiment shown in FIG. 6 is cone-shaped to accomplish the uniform and controllable distribution of slurry 118 over the circular-shaped pad 408. Slurry distribution can be further enhanced by using textured pads 408 and textured roller surface 404*a* (not shown) as described above in reference to FIGS. 4A and 4B.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for distributing slurry in chemical mechanical polishing system, comprising:

introducing slurry onto a chemical mechanical polishing surface;

moving the chemical mechanical polishing surface; and applying a roller against the chemical mechanical polishing surface as the slurry is moved on the moving chemical mechanical polishing surface toward the roller, the applying is configured to distribute the slurry as an even film over the chemical mechanical polishing surface.

2. A method for distributing slurry in chemical mechanical polishing system as recited in claim 1, further comprising:

applying a substrate to the moving chemical mechanical polishing surface having the even film of slurry.

3. A method for distributing slurry in chemical mechanical polishing system as recited in claim 1, wherein the applying of the roller against the chemical mechanical polishing surface is with a roller positioning arm that is configured with a gimbaling attachment to maintain a surface of the roller substantially parallel to the chemical mechanical polishing surface.

4. A method for distributing slurry in chemical mechanical polishing system as recited in claim 1, further comprising:

programming a pressure for the applying of the roller against the chemical mechanical polishing surface.

5. An apparatus for evenly distributing slurry over an abrasive surface used in chemical mechanical polishing of a semiconductor wafer, comprising:

a roller;

a gimbaling roller attachment connected to the roller; and a positioning arm connected to the gimbaling roller attachment, the roller being configured to assist in evenly distributing slurry over the abrasive surface.

6. An apparatus for evenly distributing slurry over an abrasive surface used in chemical mechanical polishing of a semiconductor wafer as recited in claim 5, wherein the gimbaling roller attachment is configured to maintain a constant and even pressure against the abrasive surface used in chemical mechanical polishing.

7. An apparatus for evenly distributing slurry over an abrasive surface used in chemical mechanical polishing of a semiconductor wafer as recited in claim 5, wherein the positioning arm is configured to position the gimbaling roller attachment and the roller against the abrasive surface.

8. An apparatus for evenly distributing slurry over an abrasive surface used in chemical mechanical polishing of a semiconductor wafer as recited in claim 5, further comprising:

a support roller positioned under the abrasive surface in a location that is under the roller.

9. An apparatus for distributing slurry over a polishing pad surface used in chemical mechanical polishing (CMP) of a substrate, comprising:

a belt assembly having the polishing pad surface of a given width, the belt assembly and the polishing pad surface being configured to rotate together in a loop configuration along a first direction;

a roller having a length component, the roller being positioned over the polishing pad surface such that the length component extends over the given width; and a gimbaling attachment connected to the roller, the gimbaling attachment being configured to ensure that a surface of the roller is maintained substantially parallel to the polishing pad surface along the given width.

10. An apparatus for distributing slurry over a polishing pad surface used in chemical mechanical polishing (CMP) of a substrate as recited in claim 1, further comprising:

a positioning arm connected to the gimbaling attachment, the positioning arm being configured to apply a calculated force to the roller.

11. An apparatus for distributing slurry over a polishing pad surface used in chemical mechanical polishing (CMP) of a substrate as recited in claim 10, wherein the calculated force is configured to set a slurry distribution film thickness over the polishing pad surface.

12. An apparatus for distributing slurry over a polishing pad surface used in chemical mechanical polishing (CMP) of a substrate as recited in claim 10, wherein the calculated force is configured to drive the slurry into and over a porous texture of the polishing pad surface.

13. An apparatus for distributing slurry over a polishing pad surface used in chemical mechanical polishing (CMP) of a substrate as recited in claim 10, wherein the positioning arm is further configured to position the roller along the given width of the belt to ensure substantially even distribution of slurry along the given width of the belt.

14. An apparatus for distributing slurry over a polishing pad surface used in chemical mechanical polishing (CMP) of a substrate as recited in claim 9, further comprising:

a support roller positioned under the polishing pad surface in a location that is under the roller.

15. An apparatus for combined pad conditioning and slurry distribution, comprising:

a polishing pad having a polishing pad surface;

a first roller having an abrasive surface that is configured to be applied to the polishing pad surface at a location that is before a wafer polishing application location;

a second roller being defined below the polishing pad surface so as to support the polishing pad at a location where the first roller is to be applied, the first roller being configured to condition the polishing pad surface and distribute a slurry material over the polishing pad surface before the slurry material moves to the wafer polishing application location.

16. An apparatus for combined pad conditioning and slurry distribution as recited in claim 15, wherein the abrasive material is defined by a diamond grid.

17. An apparatus for combined pad conditioning and slurry distribution as recited in claim 15, wherein the second roller is at least partially made of an elastic material.

* * * * *